United States Patent [19]

Rhodes

[11] 4,188,694

[45] Feb. 19, 1980

[54] CORONA GRID WIRE ASSEMBLY AND MOUNTING

[75] Inventor: Robert T. Rhodes, Longmont, Colo.

[73] Assignee: International Business Machines Corporation, Armonk, N.Y.

[21] Appl. No.: 962,577

[22] Filed: Nov. 20, 1978

[51] Int. Cl.[2] ..... H01J 9/14; B22D 19/00

[52] U.S. Cl. ..... 29/25.17; 29/25.18; 164/98; 164/112

[58] Field of Search ..... 29/25.18, 25.17, 25.14; 164/98, 112; 264/251; 425/111, 121

[56] References Cited

U.S. PATENT DOCUMENTS

| | | | |
|---|---|---|---|
| 1,711,069 | 4/1929 | Stuckeman | 164/112 |
| 2,920,354 | 1/1960 | Zumbrunnen | 264/251 X |

*Primary Examiner*—Richard B. Lazarus

*Attorney, Agent, or Firm*—Robert W. Lahtinen

[57] ABSTRACT

A method and apparatus for providing die cast end portions on corona grid wires and the use of a common runner to interconnect a sequence of grid wire assemblies to facilitate simultaneous connection and or assembly of a plurality of grid wires to individual resilient bifurcated retainers to form the completed charge corona assembly.

5 Claims, 9 Drawing Figures

CORONA GRID WIRE ASSEMBLY AND MOUNTING

DESCRIPTION

FIELD OF THE INVENTION

This invention pertains to a grid wire structure and the method of making the assembly and the structure of a corona device. Several methods of mounting grid wires are illustrated in the prior art. One method is to wrap or loop wires around posts or projections extending from the end blocks of the corona discharge support assembly. In another approach a grid wire is secured at one end with the opposite end portion extending through a cylindrical passageway into which a setscrew projects. A weight is secured to the end of the wire extending through the cylindrical opening which is of a magnitude to produce the proper tension in the wire and thereafter the setscrew is secured in position and the excess length of wire sheered off. Another approach is to utilize an anchor plate including hooks which receive the looped ends of grid wires with the anchor plate being received in and retained by an end block to form the charged corona assembly.

SUMMARY

In the device of the present invention grid wire assemblies are formed by feeding a wire or a series of wires into a mold and forming a first-end portion about the end of the inserted wire by die casting techniques. Thereafter the wire supply is clamped externally of the mold and a tension roller applies a predetermined tensile force to the wire intermediate the clamp and the mold and while this tensile force is maintained a second end projection is formed about the wire intermediate the first end portion and the clamping device. To further simplify the subassembly a series or bank of wires may be fed into a multiple cavity mold with the first end portions individually formed but supplied from a common runner in a manner to space and retain the end portions as required for simultaneous final assembly to a grid wire end retainer. In the assembled condition of the corona generator, the grid wires are each individually retained by a pair of grid springs which have a series of resilient arms terminating in curved bifurcated ends which capture and apply tension to the grid wire between the corresponding resilient leaf elements of the pair of springs. After assembly the grid wires may remain joined or be decommonized, dependent upon desired function.

DETAILED DESCRIPTION

Figure 1:
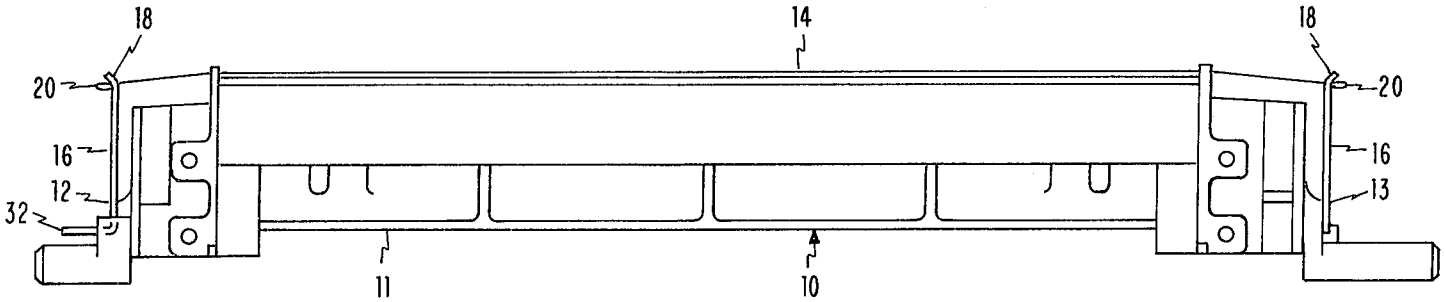
FIG. 1 is a side elevation of a charged corona assembly incorporating the present invention.

FIG. 1 shows the corona assembly 10 including a housing 11 of molded insulating material on which steel grid springs 12, 13 are mounted which retain and hold in tension the corona grid wires 14.

Figure 3:
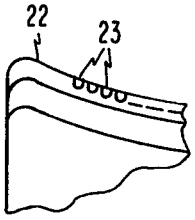
FIG. 3 is a detail of the guide portion of the body member illustrated in FIGS. 1 and 2.
Figure 4:
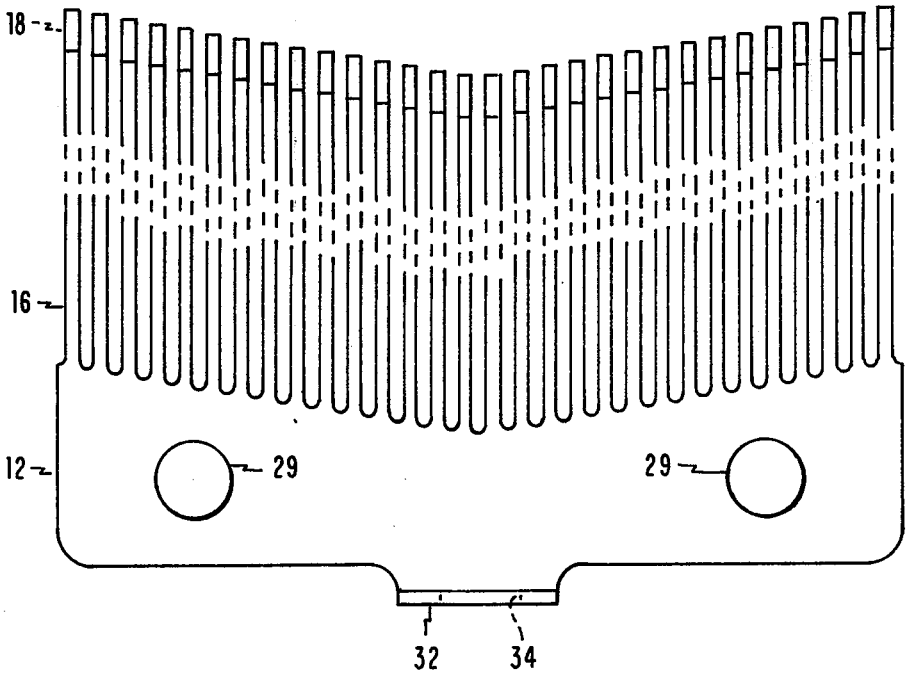
FIG. 4 is an elevation view of the grid spring.
Figure 5:
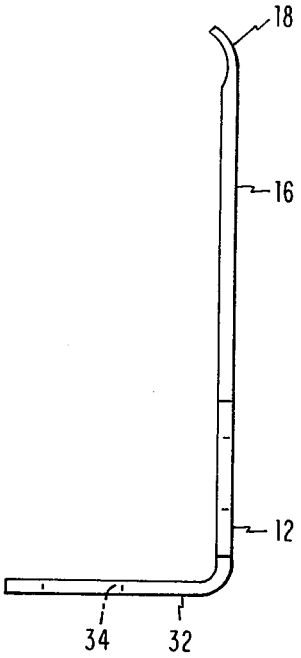
FIG. 5 is an elevation view of the grid spring of FIG. 4 as viewed from the right side of FIG. 4.
Figure 6:
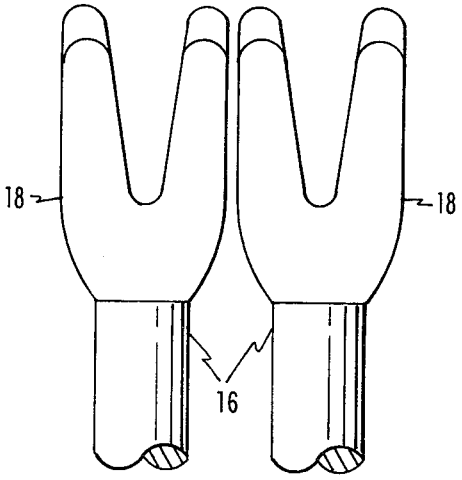
FIG. 6 shows the detailed structure of the distal end of the grid spring arms of FIG. 5.
Figure 7:
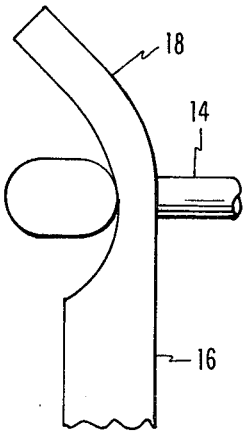
FIG. 7 is a detail view of the grid spring arm of FIG. 6 as seen from the right side of FIG. 6.

The grid spring 12 as seen in FIGS. 4 and 5 is formed of steel sheet material with a series of cantilevered spring arm elements 16. The bifurcated end 18 of spring arms 16 which appears only schematically in FIG. 4 are shown in detail in FIG. 6, and the detail of the curved configuration of the bifurcated end 18 is illustrated in FIG. 7. The bifurcated ends 18 hold the end portion 20 of grid wire 14 captive while the resilience of the spring leaf element forming arm 16 maintains the grid wire at the proper tension. The grid wire 14 is held captive and tensioned by the bifurcated leaf spring arm element 16 of grid springs 12, 13 and is positioned by being trained over the slotted guides 22 adjacent each end of base member 11. FIG. 3 illustrates a portion of a guide 22 with the positioning slots 23 formed therein.

Grid spring 12 is received in a slotted opening in the base member 11 between wall surface 25 and the projections 26 and 27. Grid spring 12 is secured to the base member 11 by screws extending through grid spring apertures 29 and received in body member bores 30. The turned end 32 extends between projections 26 and provides an electrical terminal with a bolt through grid spring aperture 34 and received in base member bore 35 also providing additional support. Grid spring 13 is similarly mounted and retained on base member 11. The grid wire assemblies 14 are trained through aligned slots 23 in the body member guide 22 and tensilely retained at each end by the spring grid arms 16 wherein the bifurcated distal ends 18 retain the enlarged ends 20 of grid wire assemblies 14.

Figure 8:
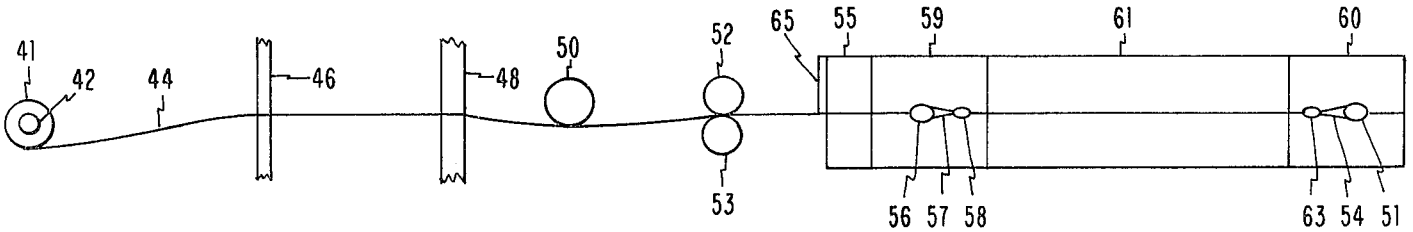
FIG. 8 is a schematic view of an apparatus for fabricating the grid wire assemblies of this invention with enlarged die cast end portions.
Figure 2:
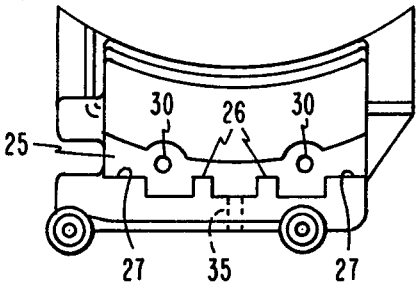
FIG. 2 is a left side elevation of the body member of the assembly of FIG. 1.

Referring to FIG. 8, the apparatus for fabricating grid wire assemblies 14 slot 13 with enlarged die cast ends 20 is schematically illustrated. Spools of wire 41 are mounted on a wire spool rack about a rod 42. Each wire 44 is handguided through a stationary wire guide 46. Beyond wire guide 46 the wires 44 are passed through an open clamp mechanism 48 (shown in a closed position), under a raised tension roll 50 and then between a pair of feed rolls 52 and 53. The wire feed roll assembly consists of two steel rollers. Lower roll 53 is made of hardened and ground steel and is in a fixed position. The upper roll 52 is also made of steel, but has a coating of 50 to 60 durometer urethane and is spring loaded toward engagement with roll 53. After passing through the drive assembly, the wires enter a converging slotted wire guide block 55. This block 55 guides the wire entry into the die casting mold segments. Wires are fed through mold 59, through a passage in mold wire guide 61 and into mold 60. Each of the guide blocks 55 and 61 is formed of two sections (upper and lower) with such upper and lower sections being parted through the wire guide channels to permit separation of the sections and removal of the corona wire assemblies. Wire feed roles 52, 53 are geared to accurately feed the proper length of wire 44. Upon completion of the feed cycle, mold 60 closes and the die casting cycle commences in such mold 60. This consists of injecting a zinc alloy through runner 51 and gates 54 into each of the cavities 63. At the termination of this initial die cast cycle, mold 60 remains in a closed position and thereafter the clamp mechanism 48 closes and the tension rolls 50 are lowered to tighten each of the wires 44. Load on the tension rolls 50 is controlled by spring pressure, and the proper tension is checked by use of a tension guage (not shown). When a proper tension is obtained the second molding cycle in mold 59 commences. This is similar to the previous molding cycle in that the zinc alloy is injected through the runner 56 and gates 57 into each of the cavities 58 within mold 59 surrounding the wire 44. Upon completion of the molding or casting cycle in mold 59 both molds are opened simultaneously. Tension rolls 50 are removed from engagement with the wire supply 44 and the cutter 65 is reciprocated downward to cooperate with the guide block 55 and sever the grid wire assembly from the wire supply 44.

Figure 9:
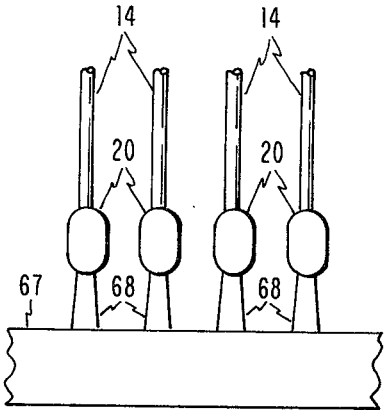
FIG. 9 is a partial view of a plurality of grid wire assemblies interconnected by a common runner.

Completed molded parts are ejected from the cavity and consist of the required number of grid wires for a corona assembly with enlarged zinc die cast ends 20. As seen in FIG. 9, the ends are commonized by a common runner 67 and gates 68 extending to the cavities to form end portions 20. This allows for a one-step operation for loading the connected plurality of grid wire assemblies into the corona assembly 10.

Alternate methods of assembling the grid wire array to the corona housing are: (1) Using tools (molds, an assembly fixture and cutting tools) mounted on a rotary table while the feed mechanism remains stationary. In operation, the first array is die cast, whereupon the molds drop away and the table indexes to an assembly fixture that contains the corona housing prepared for array insertion. Upon completion of this operation the same station may be used to shear away the die cast gates and runners to decommize the wire array. (2) A stationary tool may be used to receive and coil the molded arrays for future assembly and servering of the gates and runners.

In addition to the elements shown in FIG. 8, there might be included in the fabrication apparatus a slotted wire guide extending from adjacent wire supply spool to prevent wire crossover and a wire cleaner to remove dirt, grease and material chips from the wire supply 44.

While the preferred embodiment of the invention has been illustrated and described, it is to be understood that the invention is not to be limited to the precise construction herein disclosed and the right is reserved to all changes and modifications coming within the scope of the invention as defined in the appended claims.

Having described the invention, what is claimed as new and desired to be secured by Letters Patent is:

1. The method of fabricating a corona grid wire element with cast ends portions comprising axially feeding a wire into a mold, forming a first end portion about said wire adjacent the distal end thereof within said mold, applying tension to said wire between said first end portion and a clamping means secured to said wire, forming a second end portion about said wire within said mold at a position intermediate said first end portion and said clamping means, and severing said wire adjacent said second end portion at the side of said second end portion opposite said first end portion.

2. The method of claim 1 wherein said step of axially feeding a wire comprises the use of a pair of confronting feed rolls to draw said wire from a coiled supply and insert said wire into said mold.

3. The method of claim 2 wherein the steps of forming said first and second end portions are effected by consecutively zinc die casting said end portions about said wire within mold cavities.

4. The method of claim 3 wherein the step of applying tension to said wire comprises urging a tension roll against a stretch of said wire intermediate said clamping means and said pair of confronting feed rolls in a direction substantially perpendicular to the axis of said wire.

5. The method of claim 4 wherein the step of severing said wire comprises moving a reciprocating cutter element which shears the wire by cooperation with a mold wire guide edge surface.

* * * * *